US006282991B1

(12) United States Patent
Hu

(10) Patent No.: US 6,282,991 B1
(45) Date of Patent: Sep. 4, 2001

(54) BIASING ARRANGEMENT FOR A PAWL OF A REVERSIBLE RATCHET-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/541,190

(22) Filed: Apr. 3, 2000

(30) Foreign Application Priority Data

Feb. 3, 2000 (TW) ..... 89202279 U

(51) Int. Cl.[7] ..... B25B 13/46
(52) U.S. Cl. ..... 81/63.2; 81/60; 81/63
(58) Field of Search ..... 81/63.2, 63, 63.1, 81/62, 60, 58.4

(56) References Cited

U.S. PATENT DOCUMENTS

| | | | | |
|---|---|---|---|---|
| 15,482 | * | 8/1856 | Gilman | 81/63 |
| 1,382,492 | * | 6/1921 | Evans | 81/63 |
| 2,957,377 | * | 10/1960 | Hare | 81/63.2 |
| 3,019,682 | * | 2/1962 | Hare | 81/63.2 |
| 3,265,171 | * | 8/1966 | Kilness | 81/63 |
| 4,128,025 | * | 12/1978 | Main et al. | 81/63 |
| 4,770,072 | * | 9/1988 | Neuhaus | 81/63.2 |
| 5,076,121 | * | 12/1991 | Fosella | 81/58.4 |
| 5,157,994 | * | 10/1992 | Krivec | 81/63.2 |
| 5,178,047 | * | 1/1993 | Arnold et al. | 81/63.2 |
| 5,230,262 | * | 7/1993 | Ahlund et al. | 81/63.2 |
| 5,233,891 | * | 8/1993 | Arnold et al. | 81/63.2 |
| 5,533,427 | * | 7/1996 | Chow | 81/63.2 |
| 5,626,062 | * | 5/1997 | Colvin | 81/63.2 |
| 5,857,390 | * | 1/1999 | Whiteford | 81/62 |
| 5,957,009 | * | 9/1999 | McCann | 81/63.2 |
| 5,964,129 | * | 10/1999 | Shiao | 81/63.2 |
| 6,065,374 | * | 5/2000 | Taggart | 81/63.2 |
| 6,164,167 | * | 12/2000 | Chen | 81/63 |

* cited by examiner

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A reversible ratchet-type wrench includes a handle and a head extended from the handle and having a hole. A web is defined between the handle and the head and includes a first cavity communicated with the hole. The web further includes a compartment communicated with the first cavity and a second cavity that is communicated with the compartment. A drive member is rotatably mounted in the hole of the head. A pawl is mounted in the cavity and includes a first side with ratchet teeth for releasably engaging with teeth on an outer periphery of the drive member. A switch member is rotatably received in the compartment of the web and switchable between two ratcheting positions for changing ratcheting direction of the drive member. A pin or coil spring is mounted between the switch member and the pawl for urging the ratchet teeth of the pawl to engage with the teeth of the drive member. The switch member is positioned in one of the two ratcheting positions by a ball and an elastic element mounted in the second cavity.

38 Claims, 10 Drawing Sheets

BIASING ARRANGEMENT FOR A PAWL OF A REVERSIBLE RATCHET-TYPE WRENCH

BACKGROUND OF THE INVENTION

1. Field of the Invention

The present invention relates to a biasing arrangement for a pawl of a reversible ratchet-type wrench to provide reliable ratcheting.

2. Description of the Related Art

U.S. Pat. No. 2,957,377 issued to Hare on Oct. 25, 1960 discloses a reversible ratchet type wrench comprising a body 10 having a handle 11 and a head 12. A cap 39 and an annular wall 44 are provided to upper side and lower side of the head 12, respectively. Yet, this increases the assembly time and the manufacture cost and adversely affects the appearance. A shifting lever 35 is retained in place by a spring 33 that is located in a cylindrical opening 34. Nevertheless, formation of the cylindrical opening 34 that extends upward at air incline relatively difficult. In addition, formation of the cavity 16 having converging straight sides 17, 18 which diverge in the direction of the periphery of rotatable member 14 requires expensive and accurate computer-numeric-control (CNC), which further results in an increase in the cost together with a low production rate. This is why such a reversible ratchet type wrench is hardly seen in the market.

FIGS. 9 and 10 illustrate another conventional ratchet type wrench comprising a handle 12' and a head 11'. The head 11' is machined to form four consecutive compartments for receiving the drive member 20', the pawl 30' and the shifting lever 40', wherein three of the compartments can be formed by cutting, yet the remaining one must be machined by CNC. Further, the resultant head structure is relatively weak and thus has a poor torque-bearing capacity. In addition, the movement of the pawl 30' for changing ratcheting direction is found unreliable, as it is achieved via transmission of the hook end 442' of a spring 44' attached to the shifting lever 40'.

SUMMARY OF THE INVENTION

A reversible ratchet-type wrench in accordance with the present invention comprises:

a handle;

a head extended from the handle and including a hole, a web being defined between the handle and the head, a first cavity being defined in the web and communicated with the hole, the web further including a compartment communicated with the first cavity, the web further including a second cavity that is communicated with the compartment;

a drive member rotatably mounted in the hole of the head, the drive member including a plurality of teeth formed on an outer periphery thereof;

a pawl mounted in the first cavity and including a first side with a plurality of ratchet teeth for releasably engaging with the teeth of the drive member;

a switch member rotatably received in the compartment of the web, the switch member being switchable between two ratcheting positions for changing ratcheting direction of the drive member;

means mounted between the switch member and the pawl for urging the ratchet teeth of the pawl to engage with the teeth of the drive member; and means mounted in the second cavity for positioning the switch member in one of the two ratcheting positions.

In an embodiment of the invention, a reversible ratchet-type wrench comprises:

a handle;

a head extended from the handle and including a hole, a web being defined between the handle and the head, a first cavity being defined in the web and communicated with the hole, the web further including a compartment communicated with the first cavity, the web further including a second cavity that is communicated with the compartment;

a drive member rotatably mounted in the hole of the head, the drive member including a plurality of teeth formed on an outer periphery thereof;

a pawl mounted in the first cavity and including a first side with a plurality of ratchet teeth for releasably engaging with the teeth of the drive member, the pawl further includes a second side with a recess that faces the compartment;

a coil spring having a first end slidably received in the recess and a second end;

a switch member including a turn-piece and an actuating plate extended from the turn-piece and rotatably received in the compartment of the web, the switch member being switchable between two ratcheting positions for changing ratcheting direction of the drive member, the actuating plate including a first side that faces the first cavity and a second side that faces away from the first cavity, the first side of the actuating plate including a receptacle that has an inner receptacle section and an enlarged outer receptacle section for receiving the second end of the coil spring, the second side of the actuating plate including two positioning grooves;

the coil spring urging the ratchet teeth of the pawl to engage with the teeth of the drive member; and an elastic element mounted in the second cavity and a ball biased by the elastic element so as to be partially engaged in one of the two positioning grooves.

In another embodiment of the invention, a reversible ratchet-type wrench comprises:

a handle;

a head extended from the handle and including a hole, a web being defined between the handle and the head, a first cavity being defined in the web and communicated with the hole, the web further including a compartment communicated with the first cavity, the web further including a second cavity that is communicated with the compartment;

a drive member rotatably mounted in the hole of the head, the drive member including a plurality of teeth formed on an outer periphery thereof;

a pawl mounted in the first cavity and including a first side with a plurality of ratchet teeth for releasably engaging with the teeth of the drive member, the pawl further includes a second side with a recess that faces the compartment;

a pin having a first end slidably received in the recess and a second end;

a switch member including a turn-piece and an actuating plate extended from the turn-piece and rotatably received in the compartment of the web, the switch member being switchable between two ratcheting positions for changing ratcheting direction of the drive member, the actuating plate including a first side that faces the first cavity and a second side that faces away from the first cavity, the first side of the actuating plate including a receptacle for receiving the second end of the pin, the second side of the actuating plate including two positioning grooves; and an elastic element mounted in the second cavity and a ball biased by the elastic element so as to be partially engaged in one of the two positioning grooves, and the pin urging the ratchet teeth of the pawl to engage with the teeth of the drive member when the switch member is retained in one of the two ratcheting positions corresponding to positioning of the ball in the positioning grooves.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
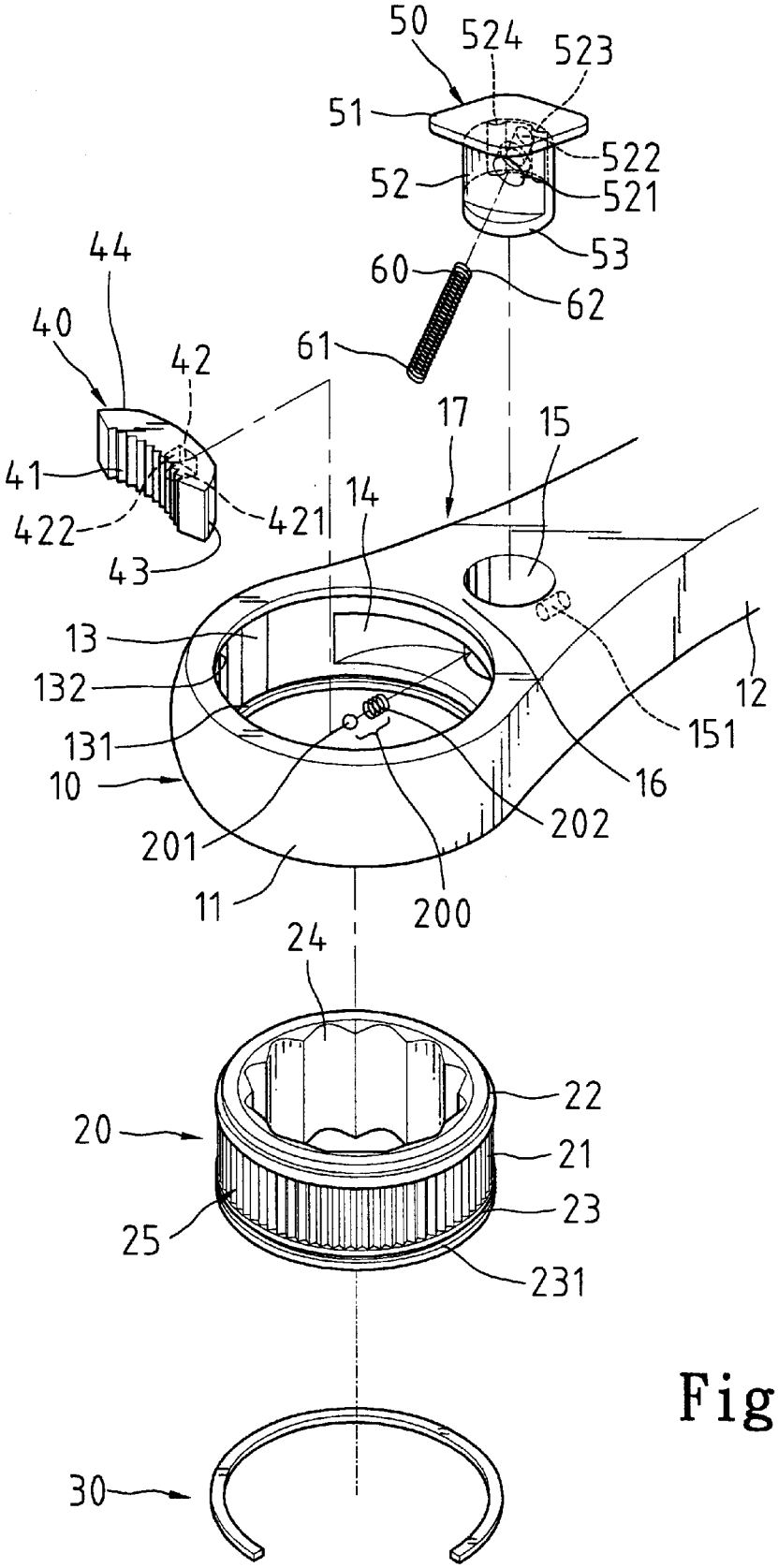
FIG. 1 is an exploded perspective view of an end portion of a first embodiment of a ratchet-type wrench in accordance with the present invention.
Figure 2:
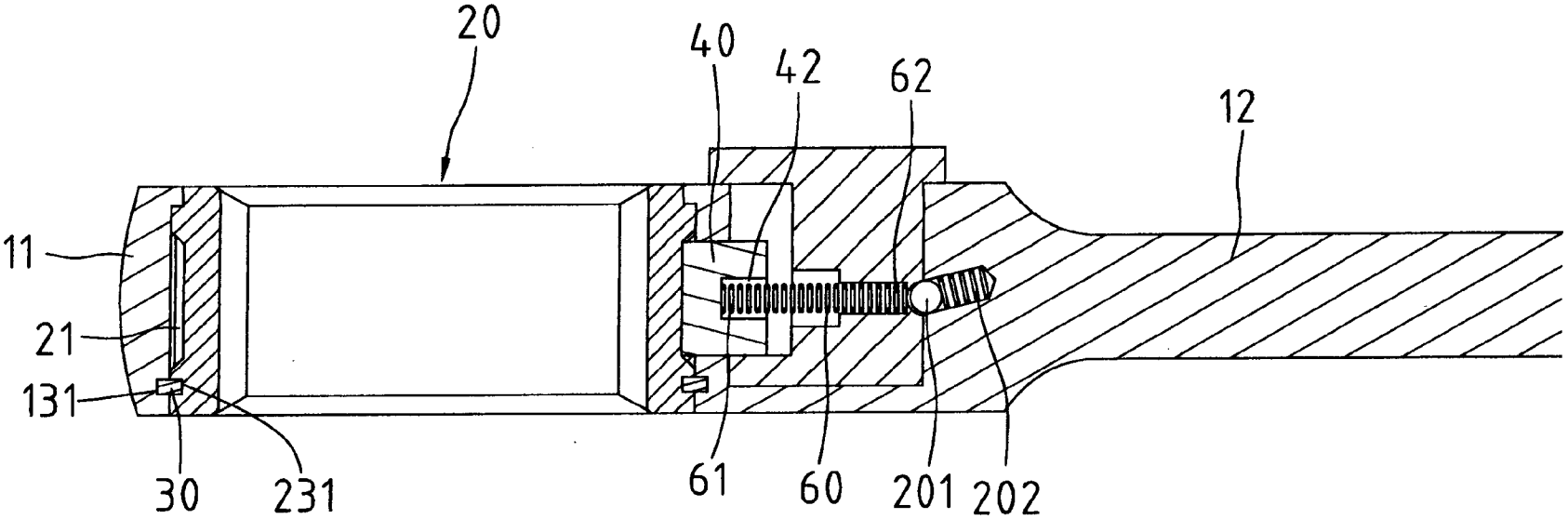
FIG. 2 is a sectional view of the end portion of the first embodiment of the ratchet-type wrench in accordance with the present invention.

Referring to FIGS. 1 through 8 and initially to FIGS. 1, 2, 3, and 6, a ratchet-type wrench 10 in accordance with the present invention generally includes a handle 12 and a head 11 having a hole 13. An inner periphery 132 defining the hole 13 of the head 11 includes an annular groove 131 in a lower portion thereof. A web 17 is defined between the head 11 and the handle 12. A cavity 14 is defined in the web 17. Also defined in the web 17 is a compartment 15 that is substantially L-shape and includes an inner end communicated with the cavity 14 and an outer end communicated with outside, thereby leaving a bridge 16 on the web 17. The outer end of the compartment 15 is preferably circular. The bridge 16 increases the strength of the head 11 and the handle 12, thereby providing a higher torque-bearing capacity.

A drive member (in the form of a gear wheel 20 in this embodiment) is mounted in the head 11 and includes an inner periphery 24 for driving a fastener (not shown) and an outer periphery 25. The outer periphery 25 includes a recessed upper end portion 22, a lower end portion 23, and a middle portion with a plurality of recessed teeth 21. The lower end portion 23 includes an annular groove 231. A C-clip 30 is received in the annular groove 231 of the lower end portion 23 and the annular groove 131 of the head 11, thereby rotatably retaining the gear wheel 20 in the head 11 of the wrench 10, best shown in FIG. 2.

A pawl 40 is mounted in cavity 14 in the web 17 and includes ratchet teeth 41 on a side thereof for engaging with teeth 21 of the gear wheel 20. The other side of the pawl 40 further includes a recess 42 having two ends 421 and 422, which will be described later. Still referring to FIGS. 1 through 3, a switch member 50 is rotatably mounted to the second end of the compartment 15. In this embodiment, the switch member 50 includes a turn-piece 51 outside the compartment 15 for manual operation and an actuating plate 52 extended from the turn-piece 51 and having a receptacle in a first side thereof that faces the cavity 14. The turn-piece 51 is shaped to allow easy grasp and turning. The actuating plate 52 is substantially cylindrical to allow smooth rotation in the compartment 15. The receptacle includes an inner receptacle section 522 and an enlarged outer receptacle section 521. The actuating plate 52 further includes a first positioning groove 523 and a second positioning 524 defined in a second side thereof that faces away from the cavity. The web 17 further includes a second cavity 151 that is communicated with the compartment 15.

Figure 3:
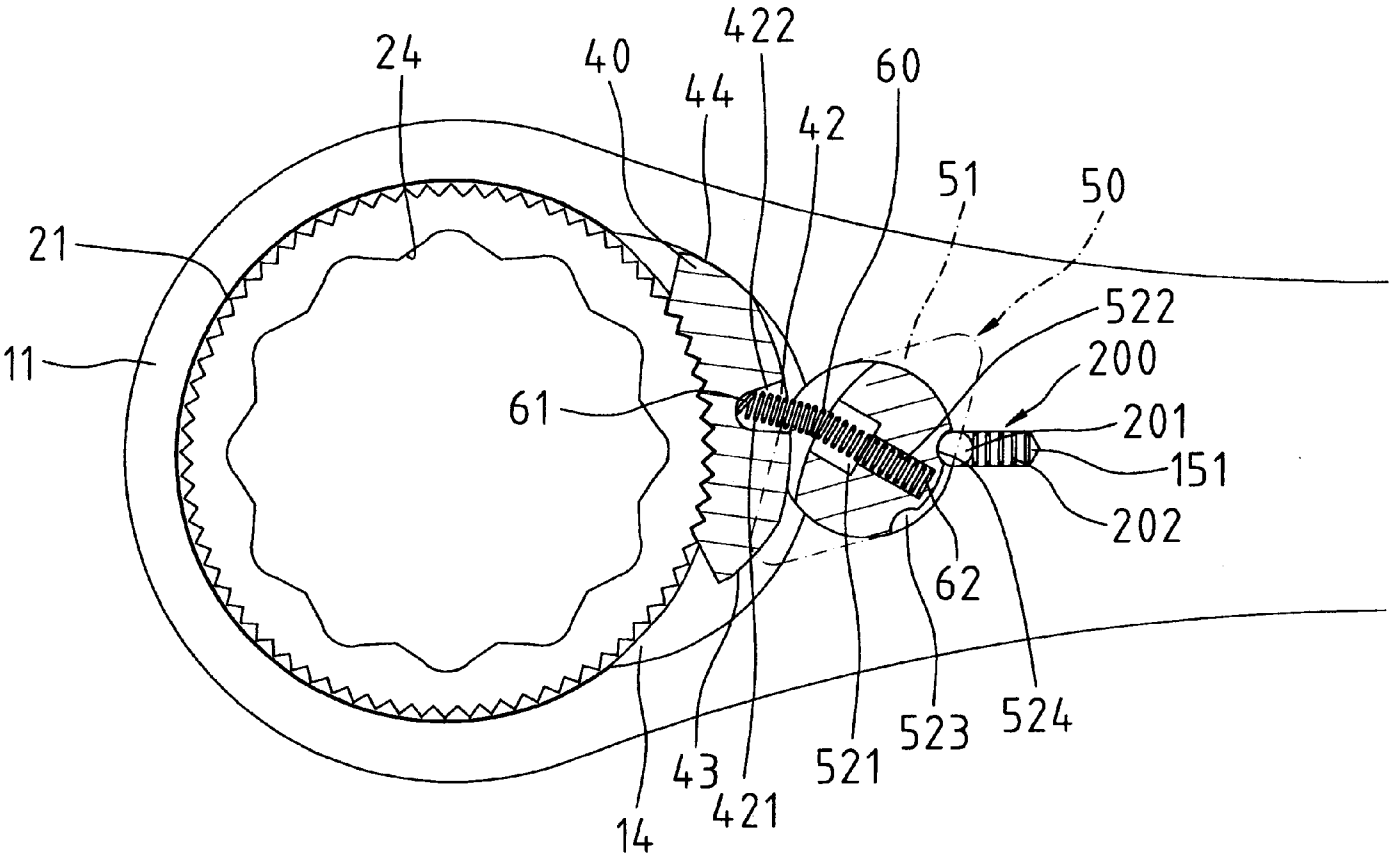
FIG. 3 is a top view, partly sectioned, of the end portion of the first embodiment of the ratchet-type wrench in accordance with the present invention, wherein the wrench is in a status allowing counterclockwise ratcheting.

An urging means 60 (e.g., in the form of a coil spring) includes a first end 61 received in the recess 42 of the pawl 40 and a second end 62 received in the receptacle of the actuating plate 52. As illustrated in FIG. 3, a positioning means 200 consisting of an elastic element 202 and a ball 201 is mounted in the second cavity 151. The ball 201 is received in one of the positioning grooves 523 and 524 for retaining the actuating plate 52 in one of two operative positions for ratcheting.

In assembly, the positioning means 200 is mounted into the second cavity 151 and the switch member 50 is then mounted in the compartment 15 with the ball 201 partially extended into one of the positioning grooves 523 and 524. Next, the second end 62 of the urging means 60 is mounted into the receptacle 521, 522 of the switch member 50 via the cavity 14. The pawl 40 is mounted into the cavity 14 with the first end 61 of the urging means 60 extended into the recess 42 of the pawl 40. The C-clip 30 is placed into the hole 13 and the gear wheel 20 is then mounted into the hole 13 with the C-clip 30 received in the annular grooves 131 and 231, thereby completing the assembly. Thus, the assembly procedure is simple and can be accomplished quickly by a C-clip 30 without the aid of any screw or cover.

Figure 4:
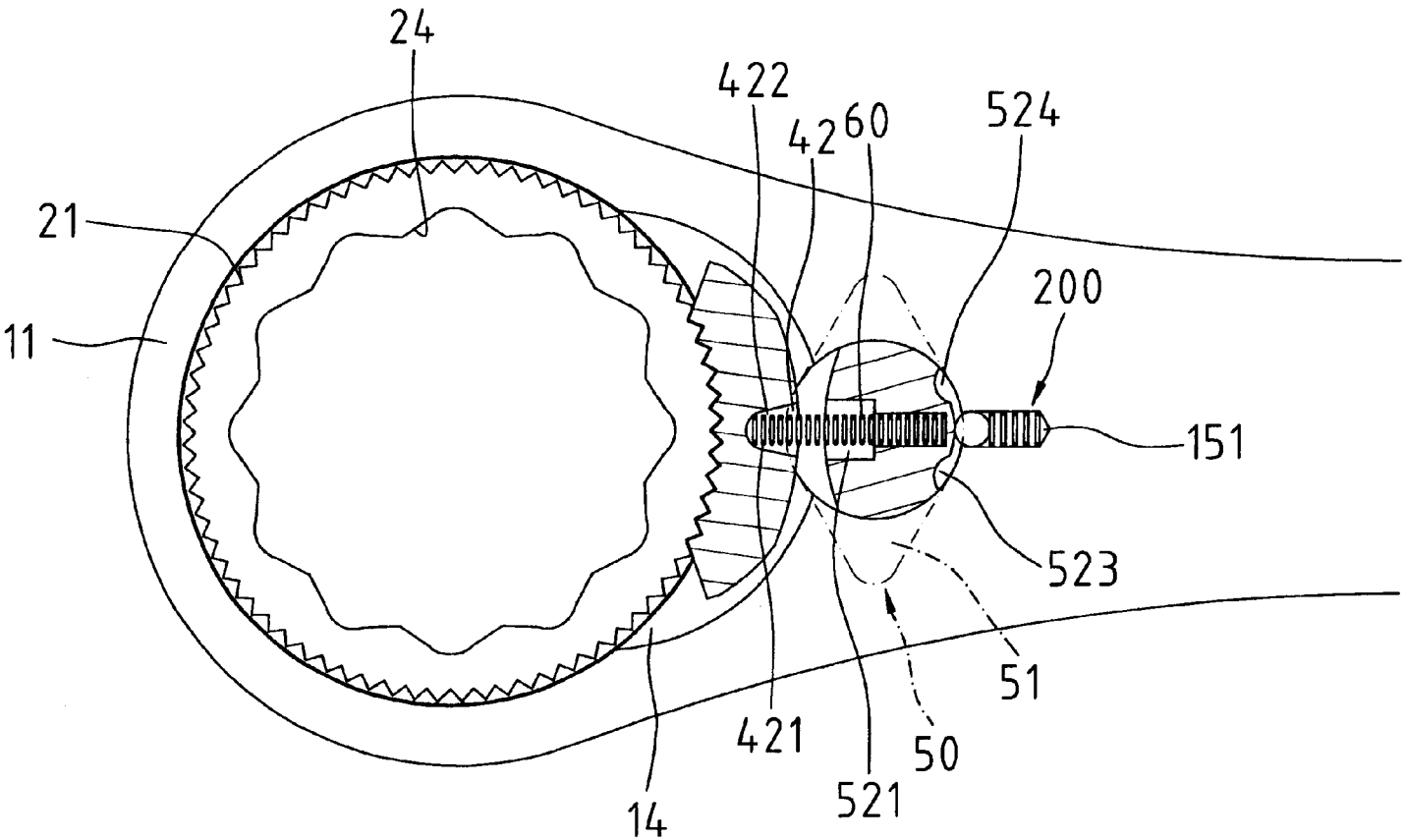
FIG. 4 is a view similar to FIG. 3, wherein the wrench is in a status allowing free rotation in both directions.
Figure 5:
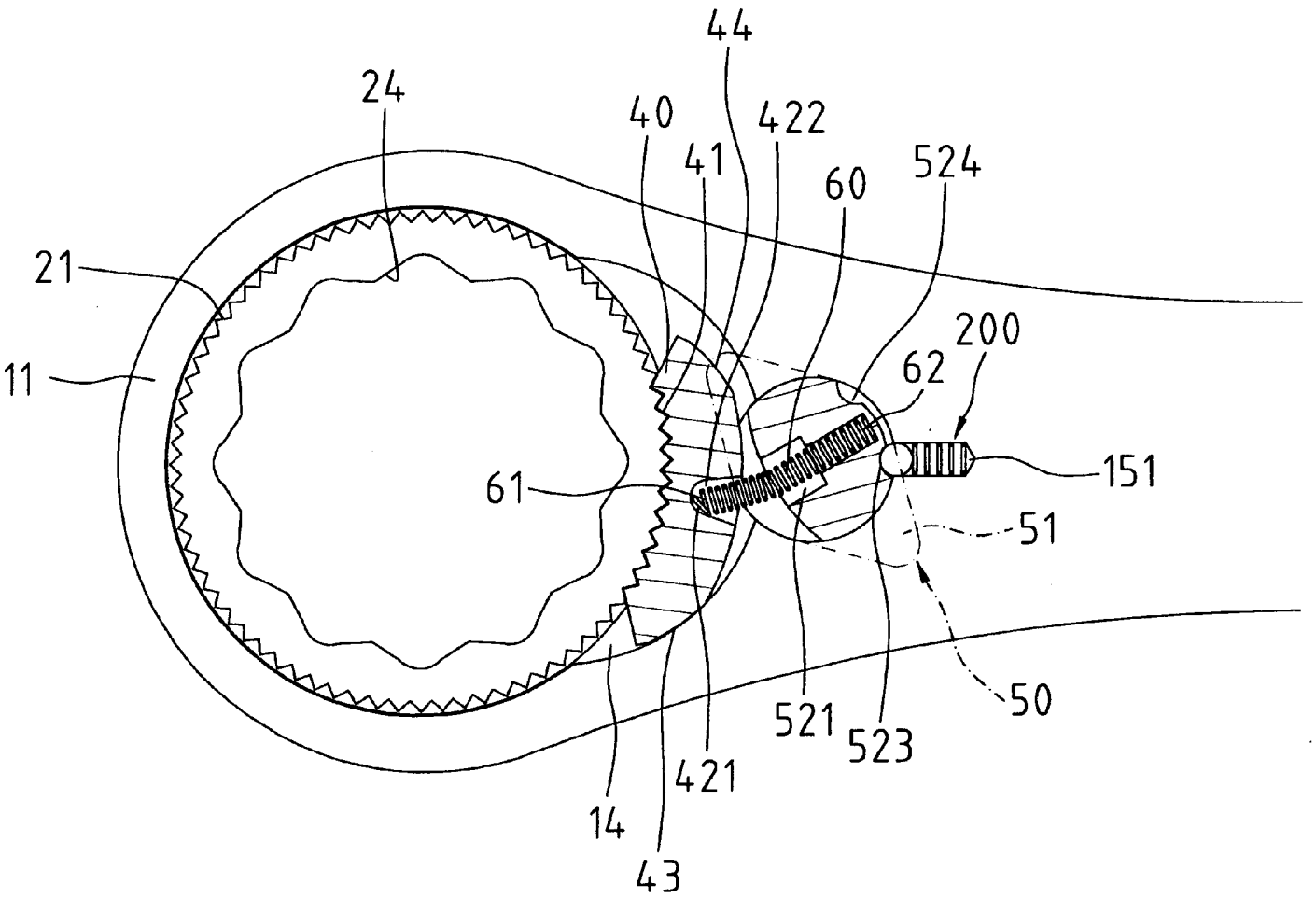
FIG. 5 is a view similar to FIG. 3, wherein the wrench is in a status allowing clockwise ratcheting.
Figure 6:
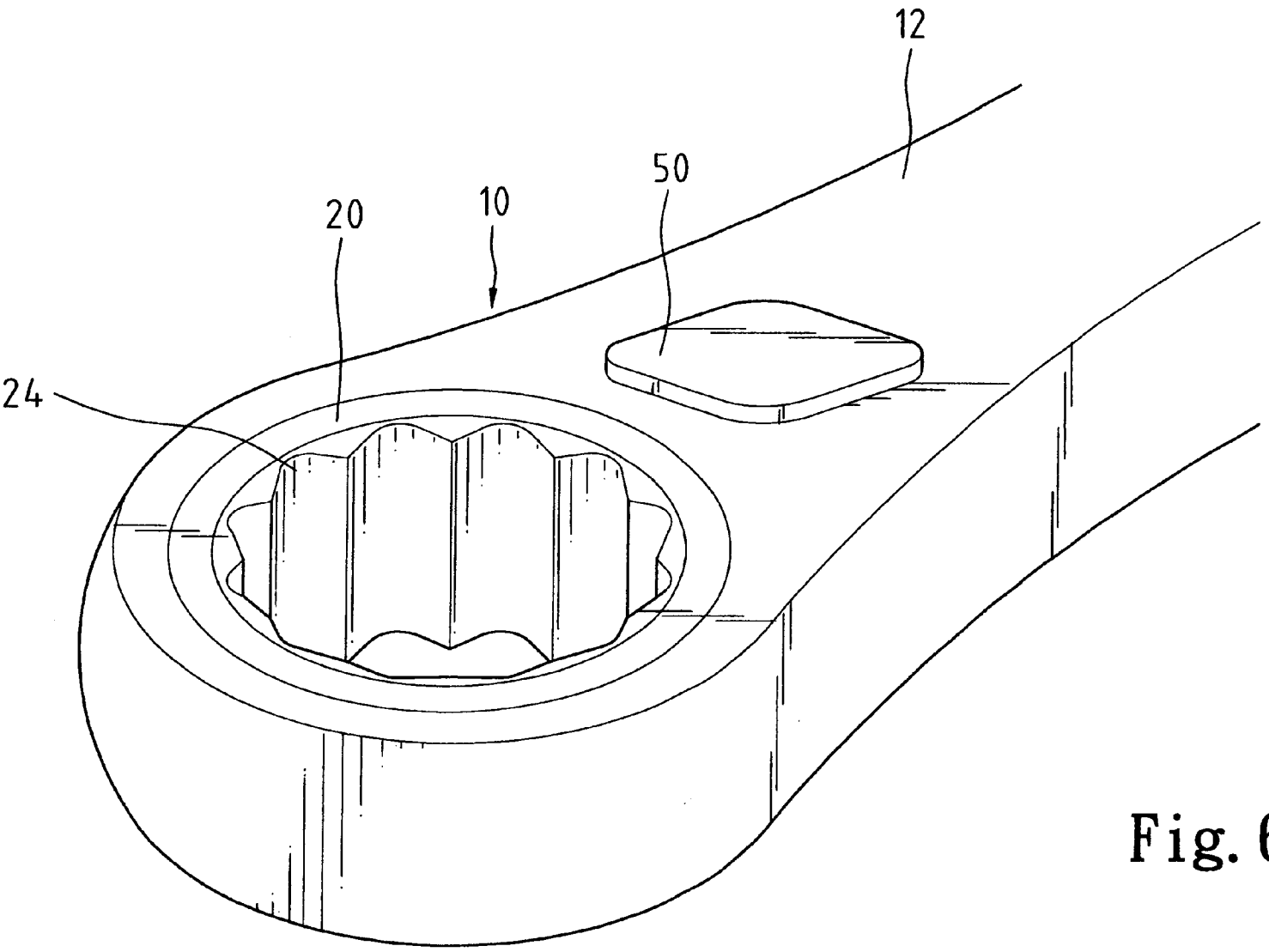
FIG. 6 is a perspective view of the end portion of the first embodiment of the ratchet-type wrench in accordance with the present invention.

The ratchet-type wrench in FIG. 3 is in a status allowing counterclockwise ratcheting (free rotation in clockwise direction), in which the first end 61 of the urging means 60 bears against an end 422 of the recess 42 of the pawl 40, and an end 44 of the pawl 40 bears against a wall portion defining the cavity 14. When a change in the ratcheting direction is required, the user may switch the turn-piece 51 and thus cause the urging means 60 to move. FIG. 4 shows a transition position for the ratchet-type wrench that allows free rotation in both directions. As illustrated in FIG. 4, the urging means 60 is stretched during rotational movement of the turn-piece 51. When the turn-piece 51 reaches its predetermined position shown in FIG. 5, the first end 61 of the urging means 60 bears against the other end 421 of the recess 42 of the pawl 40, and the other end 43 of the pawl 40 bears against another wall portion defining the cavity 14. Thus, the ratchet-type wrench is in a status allowing clockwise ratcheting and free rotation in the counterclockwise direction. It is noted that the enlarged outer receptacle section 521 of the actuating plate 52 allows deformation of the coil spring 60 during the change in the ratcheting direction.

Figure 7:
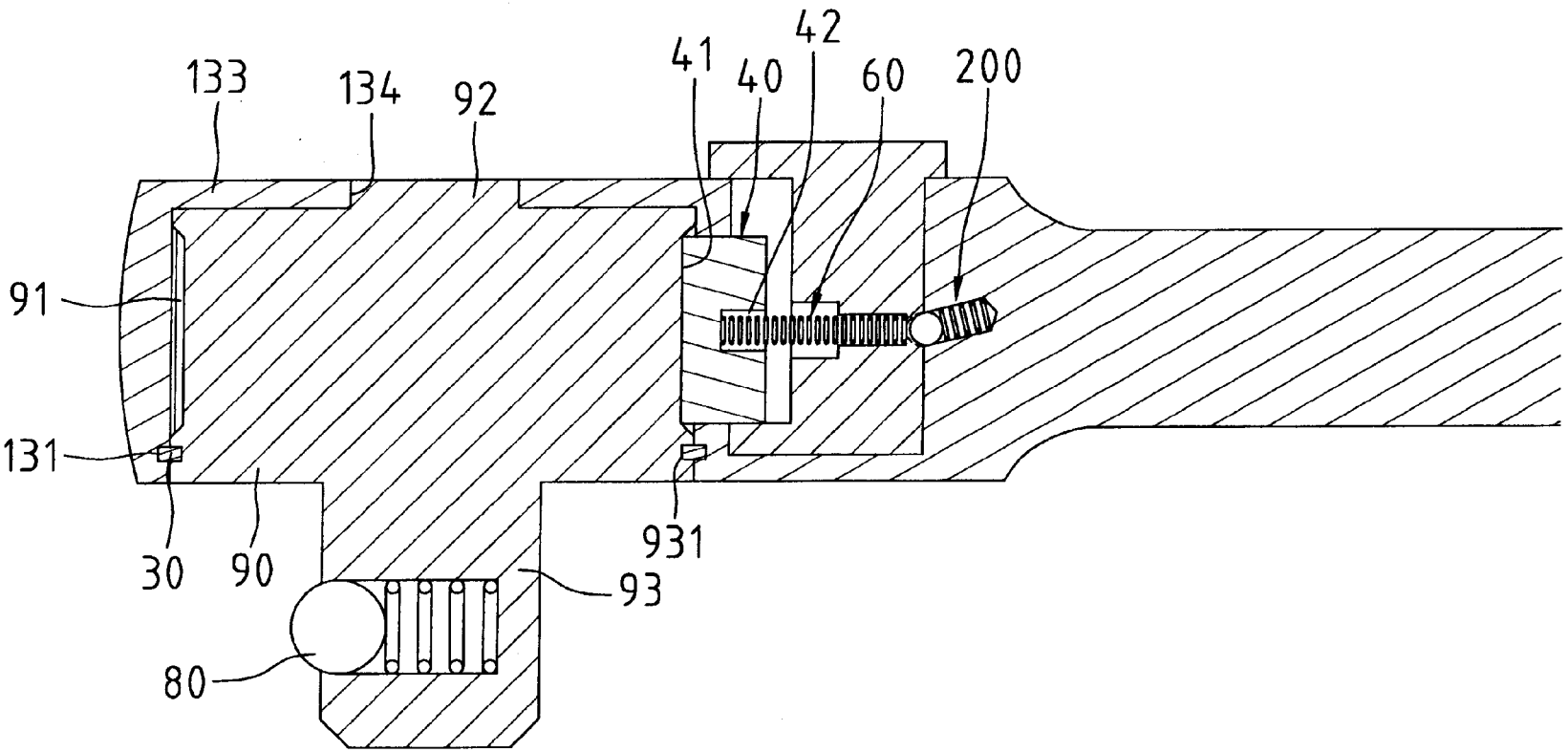
FIG. 7 is a sectional view illustrating a second embodiment of the ratchet-type wrench in accordance with the present invention.

FIG. 7 illustrates a second embodiment in accordance with the present invention, wherein the gear wheel 20 is replaced by a drive member 90 having a drive column 93 with an engaging means 80 for releasably engaging with a socket (not shown). The drive member 90 includes an outer periphery having a plurality of teeth 91 for engaging with the pawl teeth 41. An annular groove 931 is defined in a lower portion of the outer periphery of the drive member 90 for engaging with the C-clip 30, which is identical to that disclosed above. In addition, the drive member 90 includes a stub 92 on a top thereof, and the upper portion of the head 11 is modified to include an end wall 133 with an opening 134 for rotatably receiving the stub 92 of the drive member 90, thereby providing stable rotational movement for the drive member 90.

Figure 8:
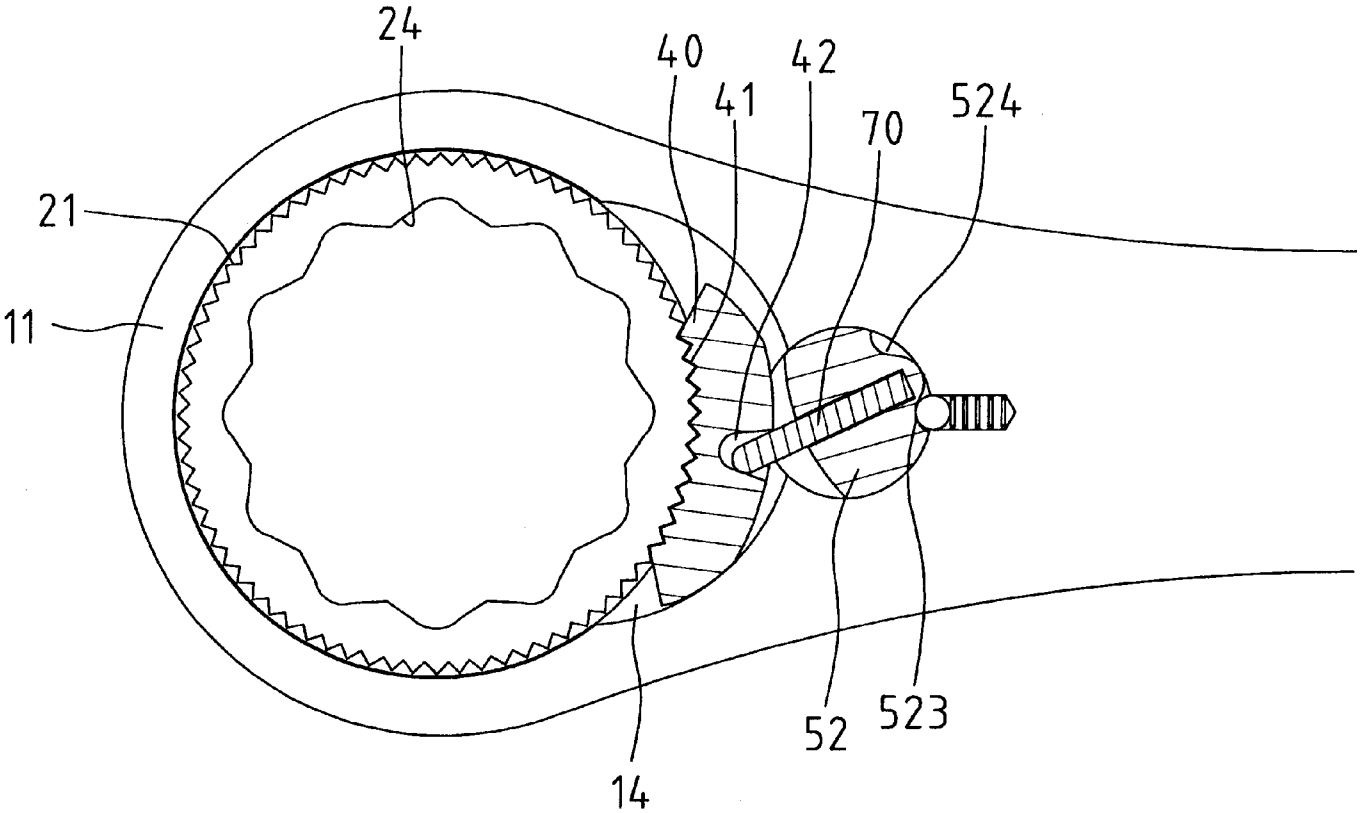
FIG. 8 is a top view of an end portion of a third embodiment of the ratchet-type wrench in accordance with the present invention.
Figure 9:
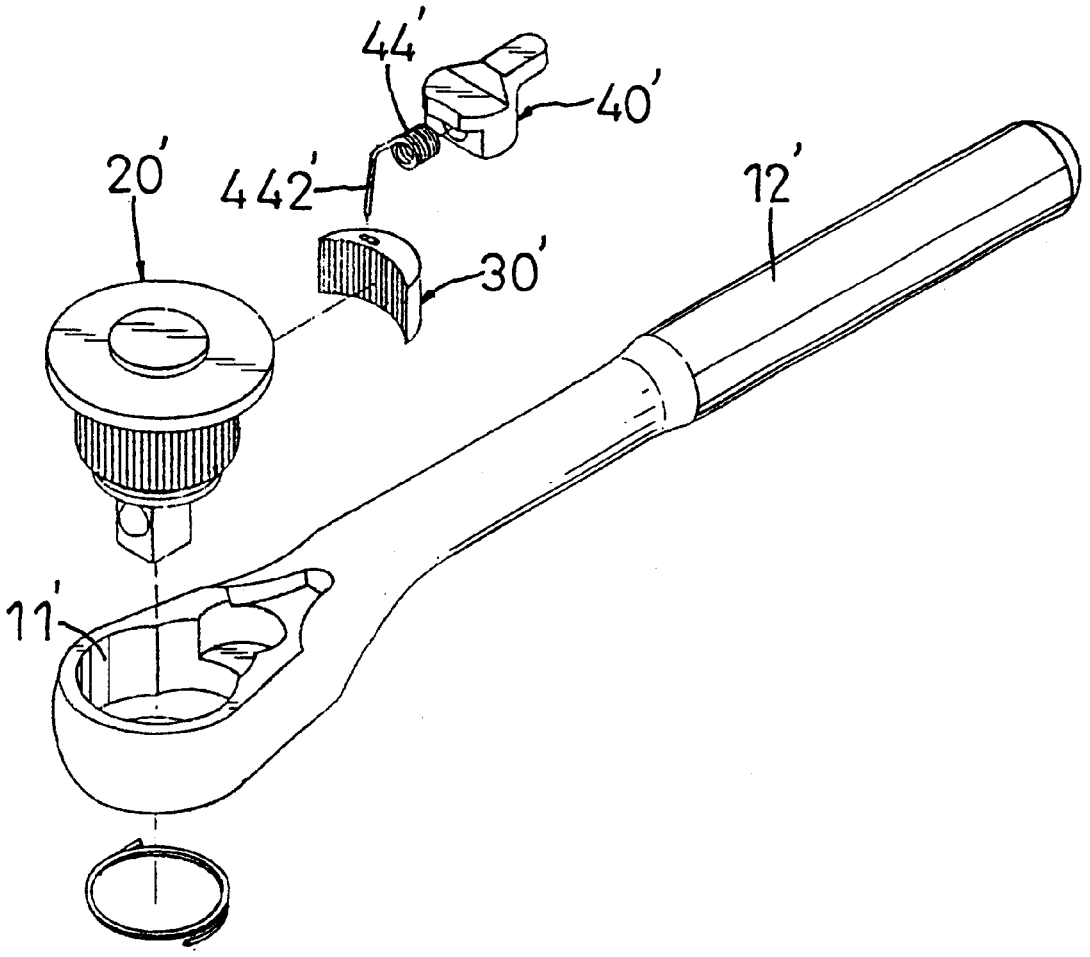
Fig. 9 PRIOR ART
FIG. 9 is an exploded perspective view of a conventional ratchet type wrench.
Figure 10:
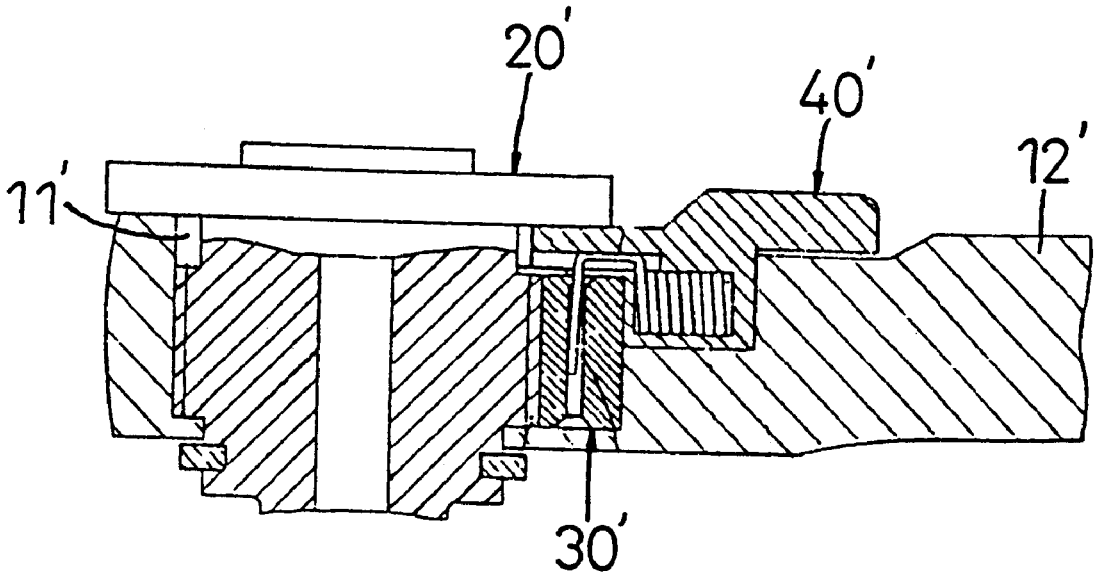
Fig. 10 PRIOR ART
FIG. 10 is a sectional view of a head portion of the conventional ratchet type wrench in FIG. 9.

FIG. 8 illustrates a third embodiment in accordance with the present invention. It is noted that the urging means in this embodiment is a rigid pin 70. The enlarged outer receptacle section in the actuating plate 52 is omitted.

Although the invention has been explained in relation to its preferred embodiment, it is to be understood that many other possible modifications and variations can be made without departing from the spirit and scope of the invention as hereinafter claimed.

What is claimed is:

1. A reversible ratchet-type wrench comprising:

a handle;

a head extended from the handle and including a hole, a web being defined between the handle and the head, a first cavity being defined in the web and communicated with the hole, the web further including a compartment communicated with the first cavity;

a drive member rotatably mounted in the hole of the head, the drive member including a plurality of teeth formed on an outer periphery thereof;

a pawl mounted in the first cavity and including a first side with a plurality of ratchet teeth for releasably engaging with the teeth of the drive member, the pawl further includes a second side with a recess that faces the compartment;

a coil spring having a first end slidably received in the recess and a second end;

a switch member including a turn-piece and an actuating plate extended from the turn-piece and rotatably received in the compartment of the web, the switch member being switchable between two ratcheting positions for changing ratcheting direction of the drive member, the actuating plate including a first side that faces the first cavity, the first side of the actuating plate including a receptacle for receiving the second end of the coil spring, with the receptacle including an inner receptacle section spaced from the first side and of a size for slideably receiving and maintaining the coil spring in a linear manner therein, with the receptacle including an enlarged outer receptacle section extending between the first side and the inner receptacle section and being of a size enlarged from the inner receptacle section and allowing the coil spring to extend in a nonlinear manner therein;

the coil spring urging the ratchet teeth of the pawl to engage with the teeth of the drive member.

2. The reversible ratchet-type wrench as claimed in claim 1, wherein the web further includes a second cavity that is communicated with the compartment; and wherein the reversible ratchet-type wrench further comprises means mounted in the second cavity for positioning the switch member in one of the two ratcheting positions.

3. The reversible ratchet-type wrench as claimed in claim 2, wherein the actuating plate includes two positioning grooves defined in a side thereof that faces away from the first cavity, and wherein the positioning means includes an elastic element mounted in the second cavity and a ball biased by the elastic element so as to be partially engaged in one of the two positioning grooves.

4. The reversible ratchet-type wrench as claimed in claim 3, wherein the drive member is a gear wheel including an inner periphery adapted to drive a fastener.

5. The reversible ratchet-type wrench as claimed in claim 3, wherein the drive member includes a drive column for releasably engaging with a socket.

6. The reversible ratchet-type wrench as claimed in claim 5, wherein the head includes a first face and a second face, with the hole extending from the first face towards but spaced from the second face, an integral end wall being defined in the head between the second face and the hole, an opening being, defined in the integral end wall extending between the second face and the hole and having a smaller diameter than and concentrically within the hole, wherein the drive member includes a stub rotatably received in the opening, and wherein the drive column extends beyond the first face.

7. The reversible ratchet-type wrench as claimed in claim 6, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

8. The reversible ratchet-type wrench as claimed in claim 7, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

9. The reversible ratchet-type wrench as claimed in claim 7, wherein the drive member includes a top and a bottom, with the outer periphery extending between the top and the bottom, with the second annular groove being spaced from the top and the bottom.

10. The reversible ratchet-type wrench as claimed in claim 1, wherein an inner periphery defining the hole of the head includes a first annular groove, and wherein the outer periphery of the drive member includes a second annular groove, further comprising a C-clip received in the first annular groove and the second annular groove, thereby retaining the drive member in the head.

11. The reversible ratchet-type wrench as claimed in claim 10, wherein the drive member includes a top and a bottom, with the outer periphery extending between the top and the bottom, with the second annular groove being spaced from the top and the bottom.

12. The reversible ratchet-type wrench as claimed in claim 10, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

13. The reversible ratchet-type wrench as claimed in claim 1, wherein the drive member is a gear wheel including an inner periphery adapted to drive a fastener.

14. The reversible ratchet-type wrench as claimed in claim 1, wherein the drive member includes a drive column for releasably engaging with a socket.

15. The reversible ratchet-type wrench as claimed in claim 14, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

16. The reversible ratchet-type wrench as claimed in claim 15, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

17. The reversible ratchet-type wrench as claimed in claim 16, wherein the drive member includes a top and a bottom, with the outer periphery extending between the top and the bottom, with the second annular groove being spaced from the top and the bottom.

18. The reversible ratchet-type wrench as claimed in claim 1, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

19. A reversible ratchet-type wrench comprising:

a handle;

a head extended from the handle and including a hole, a web being defined between the handle and the head, a first cavity being defined in the web and communicated with the hole, the web further including a compartment communicated with the first cavity;

a drive member rotatably mounted in the hole of the head, the drive member including a plurality of teeth formed on an outer periphery thereof;

a pawl mounted in the first cavity and including a first side with a plurality of ratchet teeth for releasably engaging with the teeth of the drive member, the pawl further includes a second side with a recess that faces the compartment;

a pin having a first end slidably received in the recess and a second end;

a switch member including a turn-piece and an actuating plate extended from the turn-piece and rotatably received in the compartment of the web, the switch member being switchable between two ratcheting positions for changing ratcheting direction of the drive member, the actuating plate including a first side that faces the first cavity, the first side of the actuating plate including a receptacle terminating in a closed end and for slideably receiving the second end of the pin, with the second end of the pin abutting with the closed end of the receptacle when the first end of the pin is slideably received in the recess, with the pin urging the ratchet teeth of the pawl to engage with the teeth of the drive member when the switch member is in one of the two ratcheting positions.

20. The reversible ratchet-type wrench as claimed in claim 19, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

21. The reversible ratchet-type wrench as claimed in claim 20, wherein the drive member includes a drive column for releasably engaging with a socket.

22. The reversible ratchet-type wrench as claimed in claim 21, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

23. The reversible ratchet-type wrench as claimed in claim 20, wherein the drive member is a gear wheel including an inner periphery adapted to drive a fastener.

24. The reversible ratchet-type wrench as claimed in claim 20, wherein the drive member includes a top and a bottom, with the outer periphery extending between the top and the bottom, with the second annular groove being spaced from the top and the bottom.

25. The reversible ratchet-type wrench as claimed in claim 24, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

26. The reversible ratchet-type wrench as claimed in claim 19, wherein the web further includes a second cavity that is communicated with the compartment; and wherein the reversible ratchet-type wrench further comprises means mounted in the second cavity for positioning the switch member in one of the two ratcheting positions.

27. The reversible ratchet-type wrench as claimed in claim 26, wherein the actuating plate includes two positioning grooves defined in a side thereof that faces away from the first cavity, and wherein the positioning means includes an elastic element mounted in the second cavity and a ball biased by the elastic element so as to be partially engaged in one of the two positioning grooves.

28. The reversible ratchet-type wrench as claimed in claim 27, wherein the drive member is a gear wheel including an inner periphery adapted to drive a fastener.

29. The reversible ratchet-type wrench as claimed in claim 27, wherein the drive member includes a drive column for releasably engaging with a socket.

30. The reversible ratchet-type wrench as claimed in claim 29, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

31. The reversible ratchet-type wrench as claimed in claim 30, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

32. The reversible ratchet-type wrench as claimed in claim 30, wherein the drive member includes a top and a bottom, with the outer periphery extending between the top and the bottom, with the second annular groove being spaced from the top and the bottom.

33. The reversible ratchet-type wrench as claimed in claim 32, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

34. The reversible ratchet-type wrench as claimed in claim 19, wherein the drive member is a gear wheel including an inner periphery adapted to drive a fastener.

35. The reversible ratchet-type wrench as claimed in claim 19, wherein the drive member includes a drive column for releasably engaging with a socket.

36. The reversible ratchet-type wrench as claimed in claim 35, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

37. The reversible ratchet-type wrench as claimed in claim 36, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

38. The reversible ratchet-type wrench as claimed in claim 19, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

* * * * *